US006832067B2

(12) United States Patent
Kubo

(10) Patent No.: US 6,832,067 B2
(45) Date of Patent: Dec. 14, 2004

(54) CLEANING APPARATUS INCLUDING A TONER BREAKING MEMBER AND IMAGE FORMING APPARATUS USING SAME

(75) Inventor: Norihiko Kubo, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/068,842

(22) Filed: Feb. 11, 2002

(65) Prior Publication Data

US 2002/0131799 A1 Sep. 19, 2002

(30) Foreign Application Priority Data

Mar. 19, 2001 (JP) ..... 2001-078448

(51) Int. Cl.[7] ..... G03G 21/00; G03G 21/10
(52) U.S. Cl. ..... 399/350; 399/358
(58) Field of Search ..... 399/350, 351, 399/358, 360

(56) References Cited

U.S. PATENT DOCUMENTS 4,982,240 A * 1/1991 Nakano ..... 399/350
6,055,405 A * 4/2000 Knott et al. ..... 399/358
6,463,254 B1 * 10/2002 Maul et al. ..... 399/350

* cited by examiner

*Primary Examiner*—William J. Royer
(74) *Attorney, Agent, or Firm*—Fitzpatrick, Cella, Harper & Scinto

(57) ABSTRACT

A cleaning apparatus includes a cleaning member contacting with a surface of an image bearing body bearing a toner image for collecting toner, a toner carrying member for carrying the collected toner and a toner breaking member disposed in the vicinity of a contact portion between the image bearing body and the cleaning member for breaking the toner in the vicinity of the contact portion. The toner breaking member moves in cooperation with a toner carrying operation of the toner carrying member.

26 Claims, 8 Drawing Sheets

CLEANING APPARATUS INCLUDING A TONER BREAKING MEMBER AND IMAGE FORMING APPARATUS USING SAME

BACKGROUND OF THE INVENTION

1. Field of the Invention

The present invention relates to an electrophotographic recording type cleaning apparatus and an image forming apparatus such as a copying machine, a printer or a facsimile machine.

2. Related Background Art

A multifunction machine as an all in one output terminal including a copying machine, a printer and a facsimile and so on has been extensively available on the market. An electrophotographic system has been widely used as the above output terminal connectable to such a network. However, a duty cycle of a body is pointed out as one of serious issues. The duty cycle means the maximum limit number of the sheets within which the body may continuously work without service maintenance. A service life of a photosensitive drum may be pointed out as a critical factor of the duty cycle.

Also from an ecological point of view, it becomes an important task to obviate wasted material, i.e., to reduce the amount of consumable products, to postpone a service life of the consumable material and to enhance reliability. Also, the digitalization has been accelerated from the conventional analog apparatus. Thus, it also becomes an important task to reduce the cost of the body to the same level of the analog apparatus or less. Thus, it also becomes an important task to reduce the cost of the body to the same level of the analog apparatus or less.

Furthermore, recently, although a mono-color (black and white type) machine has been mainly conventionally used for a copying machine and a printer, a full-color output file or original has been increasingly used also in a work office. Accordingly, it becomes an important task to provide a full-color printer that has substantially the same cost of the body and of the same running cost as those of the mono-color machine. For this reason, it is desirable to provide a technology that may drastically reduce TCO (total cost of ownership).

Under such a state, recently, a color image forming apparatus which is provided with a plurality of photosensitive bodies (image bearing bodies) and a transfer belt for bearing and carrying a recording material whereby a color image may be obtained by overlapping in order toner images having different colors and formed on the photosensitive bodies, respectively, to the recording material held on this transfer belt, i.e., a four continuous drum type color image forming apparatus has been provided.

In an image forming apparatus in which a step for transferring a transferable toner image formed on an image bearing body surface to a recording material that is mainly made of paper, it is necessary to sufficiently remove residual toner residing on the image bearing body without moving to the recording material every time upon the transfer.

For this reason, various approaches have been conventionally proposed as a cleaning means for the image bearing bodies. In the above-described system, residual toner is scraped by cleaning blades made of elastic material such as urethane rubber is in practical use because of being simple in structure, compact in size, low in cost and superior in its toner-removing function. In general, urethane rubber that is very hard, abundant in elasticity and excellent in wear-resistant property, mechanical strength, oil-resistant property, and ozone-resistant property is used as the rubber material for the cleaning blades.

In the case where such a cleaning blade type cleaning apparatus is used, the toner collected by the blades is likely to reside in the vicinity of edges of the blades. If such a state is continued, a large amount of toner is likely to be present in a contact portion between the blade and the image bearing body (blade nip portion). There is a fear that a sliding friction blemish (a blemish caused by sliding) is generated on the side of the image bearing body due to inorganic particles such as external additives contained in the toner, or the like to cause an image fault.

As a method for reducing the frictional damage of the image bearing body, steps for reciprocating the cleaning blade in a longitudinal direction of the image bearing body at a predetermined width to thereby prevent the growth of the sliding friction blemish at the same position in the longitudinal direction to make the damage unremarkable have been performed.

However, even according to this method, although the sliding friction blemish of the image bearing body can be moderated, in terms of long service life and high quality, it is necessary to give a further improvement thereto.

On the other hand, as a measure for prolonging the service life of the copying machine, a chemical measure for using material that is difficult to abrade to the surface of the image bearing body to be used or for dispersing fluorine resin particles and imparting the slidability thereto and a physical measure for changing an AC charging method or a DC charging method to a corona charging method have been taken. In comparison with the AC charging method, it is confirmed that, the abrasion amount of the image bearing body is half the abrasion amount of the corona charging method or less.

By the above-described measures although the service life of the image bearing body is prolonged by the above-described method, inversely, the image bearing body is difficult to abrade. Accordingly, there is a fear that the adhesives adhered to the above-described image bearing body surface could not be scraped so that bonding or filming occurs to cause the image fault disadvantageously. Accordingly, changing the external adding method of the toner, the amount of the external additives that have the polishing effect is to be increased so that the surface of the above-described image bearing body is polished by means of the external additives interposed between the cleaning blade and the surface. Otherwise, in order to enhance the scraping ability of the cleaning blade per se, the coating layer made of material having a low frictional coefficient is provided on the surface of the blade. According to this blade, it is possible to perform the cleaning operation without fluttering (abnormal vibration) or curling of the blade, and in addition, the blade edge is very hard. Accordingly, it is possible to obtain an effect of effectively removing the adhesives adhered to the surface of the image bearing body and of suppressing the bonding or filming.

However, it becomes clear that the issue of the abrasion damage on the image bearing body surface due to the residual toner in the vicinity of the above-described blade nip particularly becomes remarkable in the case where the coating having a low wear is applied to the blade or depending upon the amount or the kind of the external additives to the toner. In general, since the coating agent is a material having a higher hardness than that of the blade base member, this is because the contact pressure of the toner that is present in the blade nip portion and the external additives to the image bearing body is increased.

SUMMARY OF THE INVENTION

In view of the above-noted defects, an object of the present invention is to provide a cleaning apparatus and/or an image forming apparatus in which a sliding friction blemish on a surface of an image bearing body can effectively be suppressed.

In order to achieve the above-mentioned object, according to the present invention, a cleaning apparatus is characterized by comprising: a cleaning member for collecting toner by contacting with a surface of an image bearing body for bearing a toner image; toner conveying means for conveying (carrying) the collected toner; and a toner breaking member disposed in the vicinity of a contact portion between the image bearing body and the cleaning member for breaking the toner in the vicinity of the contact portion, in which the toner breaking member moves in cooperation with a toner carrying operation of the toner carrying means.

According to another preferred aspect of the present invention, a cleaning apparatus is characterized by comprising: a cleaning member contacting with a surface of an image bearing member bearing a toner image for collecting toner; cleaning member moving means for holding the cleaning member and moving in reciprocation in a longitudinal direction of the image bearing body; a toner breaking member coupled with the cleaning member moving means and disposed in the vicinity of a contact portion between the image bearing body and the cleaning member for breaking the toner in the vicinity of the contact portion; and toner carrying means for carrying the collected toner, in which at least a part of the toner breaking member is arranged in a position where the part interferes with the toner carrying means.

In order to achieve the above-mentioned object, according to a preferred aspect of the present invention, an image forming apparatus is characterized by comprising: image forming means for forming a toner image on a surface of an image bearing body; transfer means for transferring the toner image on the image bearing body to a recording material; a cleaning member contacting with a surface of the image bearing body for collecting toner; toner carrying means for carrying the collected toner; and a toner breaking member disposed in the vicinity of a contact portion between the image bearing body and the cleaning member for breaking the toner in the vicinity of the contact portion, in which the toner breaking member moves in cooperation with a toner carrying operation of the toner carrying means.

According to another preferred aspect of the present invention, an image forming apparatus is characterized by comprising: image forming means for forming a toner image on a surface of an image bearing body; transfer means for transferring the toner image on the image bearing body to a recording material; a cleaning member contacting with a surface of the image bearing body for collecting toner; cleaning member moving means for holding the cleaning member and moving in reciprocation in a longitudinal direction of the image bearing body; a toner breaking member coupled with the cleaning member moving means and disposed in the vicinity of a contact portion between the image bearing body and the cleaning member for breaking the toner in the vicinity of the contact portion; and toner carrying means for carrying the collected toner, in which at least part of the toner breaking member is located in a position where the part interferes with the toner carrying means.

DESCRIPTION OF THE PREFERRED EMBODIMENTS

An image forming apparatus used in the embodiment of the invention will now be described.

Figure 1:
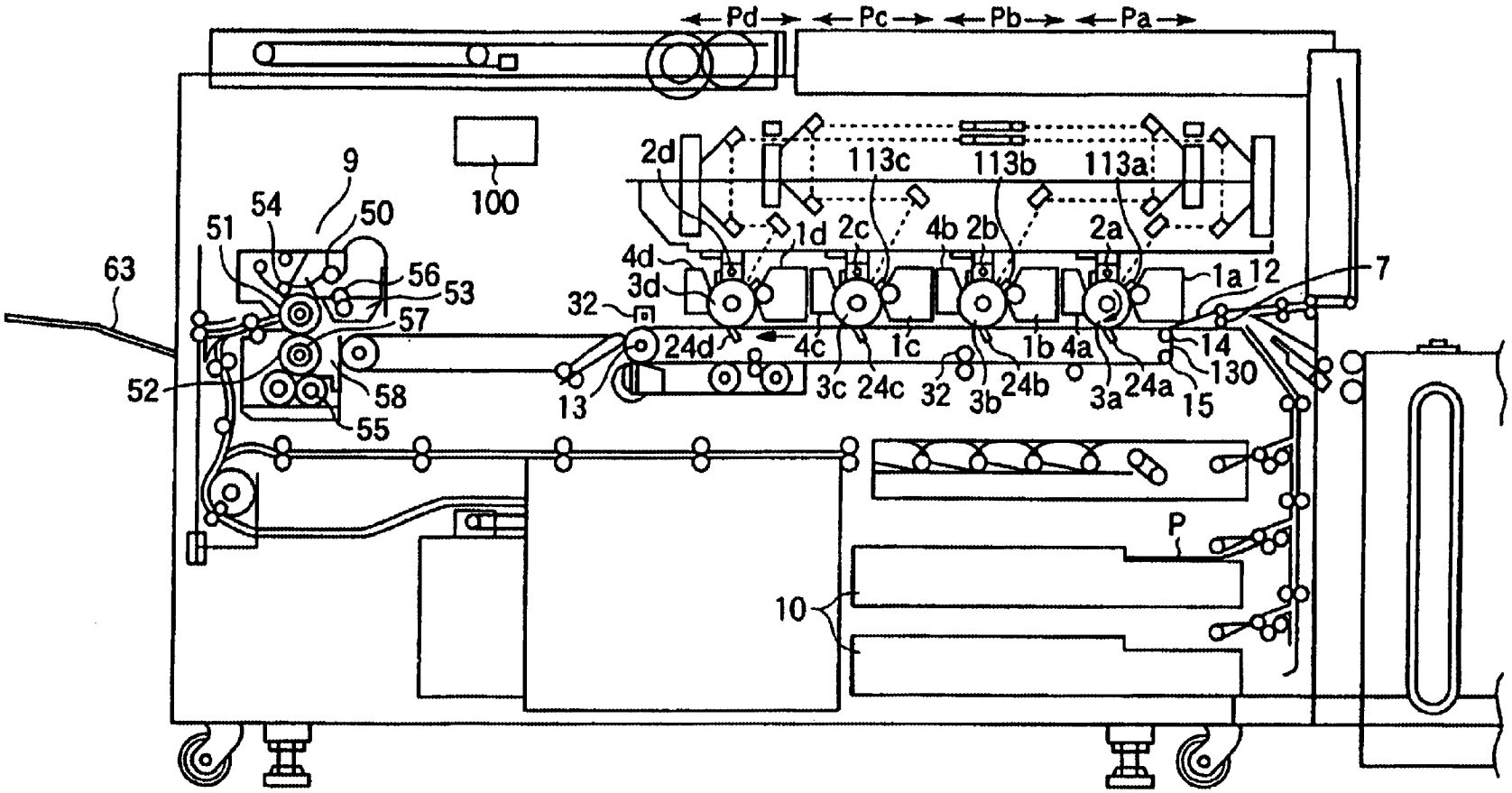
FIG. 1 is a schematic view of a four-ganged drum type color electrophotographic copying apparatus having an image bearing body cleaning means to which the present invention is applicable.

FIG. 1 is a cross-sectional illustrative view showing an overall structure of a four-continuous drum type color electrophotographic copying apparatus having an image bearing body cleaning means and a transfer belt cleaning means as one example of an image forming apparatus.

Image forming portions Pa, Pb, Pc and Pd incorporating therein process means are disposed in a lateral direction in the interior of the image forming apparatus. An endless transfer belt 130 is laid around belt drive rollers 13, 14 and 15 in the lower portions of the image forming portions Pa, Pb, Pc and Pd. The above-described transfer belt 130 is rotated by rotating the belt drive roller 13 in a direction indicated by an arrow by means of a drive motor (not shown). Reference numeral 10 denotes cassettes which receive recording sheet P that is a recording medium. The recording sheet P received in the above-described cassettes 10 is to be fed from the uppermost side. A skew of the recording sheet P is corrected by a pair of registration rollers 7 and simultaneously the recording sheet P is synchronized with the image forming portions Pa, Pb, Pc and Pd to be fed onto the transfer belt 130. Reference numeral 12 denotes a conveying guide for guiding the above-described recording sheet P to the transfer belt 130 by the pair of registration rollers.

The structure of the image forming portions Pa, Pb, Pc and Pd will now be described. The image forming portions Pa, Pb, Pc and Pd have photosensitive drums 3*a*, 3*b*, 3*c* and 3*d* that are rotatable image bearing bodies, primary chargers 2*a*, 2*b*, 2*c* and 2*d* that constitute process means around the drums, developing devices 1*a*, 1*b*, 1*c* and 1*d*, transfer chargers 24*a*, 24*b*, 24*c* and 24*d*, cleaning means 4*a*, 4*b*, 4*c* and 4*d* and pre-exposure light sources 113*a*, 113*b* and 113*c* (although the light source is also present in the Pd portion, the light source is not shown), respectively. Laser beam scanners are provided above the photosensitive drums 3*a*, 3*b*, 3*c* and 3*d*.

The above-described primary chargers 2*a*, 2*b*, 2*c* and 2*d* are used to charge uniformly the drum surface before exposure of the photosensitive drums 3*a*, 3*b*, 3*c* and 3*d*. The developing devices 1*a*, 1*b*, 1*c* and 1*d* are used to add the respective toners of black, magenta, yellow and cyan to the electrostatic latent image exposed and formed on the drum surface to form a visual image (toner image). Also, the transfer chargers 24*a*, 24*b*, 24*c* and 24*d* are used to transfer the toner image formed on the photosensitive drums 3*a*, 3*b*, 3*c* and 3*d* to the recording sheet P. The cleaning means 4*a*, 4*b*, 4*c* and 4*d* are used to remove the residual toner adhered to the drum surface after the image transfer. The pre-exposure light sources 113*a*, 113*b* and 113*c* (although the light source is also present in the Pd portion, the light source is not shown) are adapted to remove the surface potential of the photosensitive drums 3*a*, 3*b*, 3*c* and 3*d*. The laser beam scanners have semiconductor lasers, polygonal mirrors, fθ lenses and the like and are adapted to receive the input of the electric digital image signal and to project and expose a laser beam modulated corresponding to that signal in the generatrix direction of the photosensitive drums 3*a*, 3*b*, 3*c* and 3*d*.

Reference numeral 32 denotes a separating charger for separating the recording sheet P that has been conveyed along the transfer belt 130. Reference numeral 9 denotes a fixing device for fixing the toner image transferred to the recording sheet P and has a fixing roller 51 having therein a heating means such as a heater and a pressure roller 52 to be brought into contact with the fixing roller 51.

Reference numeral 63 denotes a discharge tray for stacking the recording sheet P that has been discharged to the outside of the apparatus.

In the example of this image forming apparatus, the bearing and conveying means for bearing and conveying the recording medium is composed of the above-described belt drive roller 13, the transfer belt 130, the drive motor (not shown), the registration rollers 7 and the conveying guide 12.

A charging means for charging the image bearing body 3*a*, 3*b*, 3*c* and 3*d* is composed of the above-described primary charger 2*a*, 2*b*, 2*c* and 2*d*, an assistant charger (not shown) and the like.

A toner image forming means for forming the toner image on the image bearing body 3*a*, 3*b*, 3*c* and 3*d* is composed of the above-described developing device 1*a*, 1*b*, 1*c*, 1*d*, laser beam scanner (not shown), the assistant charger (not shown) and the like.

A means for transferring the toner image to the recording medium held on the bearing and conveying means is composed of the above-described transfer charger 24*a*, 24*b*, 24*c* and 24*d*.

The cleaning means 4*a*, 4*b*, 4*c* and 4*d* for cleaning the image bearing body 3*a*, 3*b*, 3*c* and 3*d* is the above-described cleaning apparatus.

The image forming operation will now be described. When the image forming operation start signal is input into the apparatus body, the photosensitive drum 3*a* is started to rotate in the direction indicated by the arrow and charged uniformly by means of the primary charger 2*a*, and the laser beam modulated by the image signal corresponding to the black component of the original image is projected onto the drum surface by means of the laser beam scanner to form the electrostatic latent image (exposure). Subsequently, the toner of black color is fed by means of the developing device 1*a*to form the toner image in which the above-described latent image is visualized.

On the other hand, the recording sheet P received in the cassette 10 is fed and its skew is corrected by means of the pair of registration rollers 7 that have been stopped temporarily. Thereafter, the recording sheet P is conveyed onto the transfer belt 130 taking timing with the toner image formed on the above-described photosensitive drum 3*a*. The recording sheet P that has been fed to the transfer belt 130 is subjected to the transfer charge by means of the transfer charger 24*a* in the transfer portion of the image forming portion Pa so that the toner image is transferred to the recording sheet P. The above-described steps are performed also in the image forming portions Pb, Pc and Pd in the same manner so that the toner image of the magenta color, the toner image of the yellow color and the toner image of the cyan color are sequentially transferred onto the recording sheet P.

The recording sheet P that has been subjected to the image transfer is separated by means of the transfer belt 130 while being subjected to an AC bias by the separating charger 32 in the left end portion of the transfer belt 130 and is conveyed to the fixing device 9. Then, the recording sheet P that has been subjected to the image fixation by the above-described fixing device 9 is discharged to a discharge tray 63 outside the apparatus.

Incidentally, the maximum image width in the electrophotographic copying machine according to this embodiment is about 290 mm in the lateral side of A4, and the drum peripheral velocity is 200 mm/sec. As an example of the structure of the photosensitive drum, the drum has a conductive base member, a charge generating layer coated thereon, a charge transporting layer formed thereon and a mold separating layer farther formed thereon and containing Teflon.

An example of the cleaning apparatus will now be described with reference to FIG. 2. A cleaning blade C brought into contact with a surface of a photosensitive drum A is kept in a cleaning container of the cleaning apparatus 4*a*, 4*b*, 4*c* and 4*d*.

Figure 7:
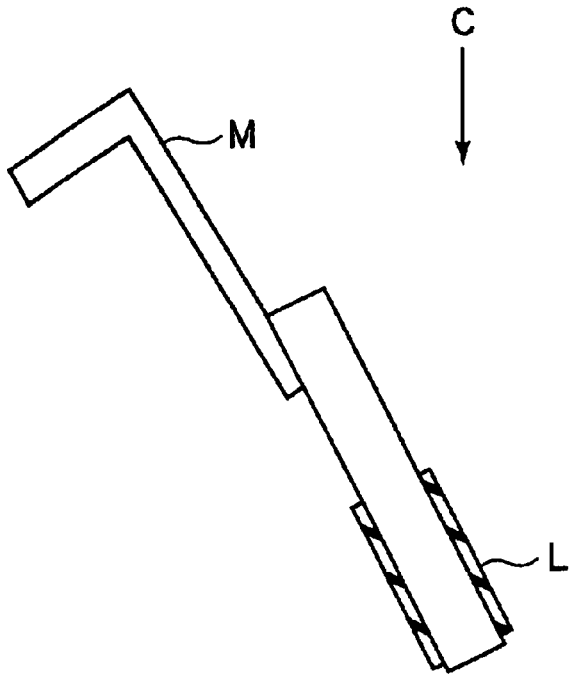
FIG. 7 is a schematic view of a blade in which nylon layers dispersed with carbon fluoride are formed on both surfaces of the blade in accordance with a dipping method.

The cleaning blade C is an elastic blade mainly made of urethane with a hardness of 77 degrees (Hs), a repulsive elasticity of 41% (repulsive elasticity of 63% at 40° C.), and 300% of modulus 200 (kgf/cm$^2$) (any one of which is based upon JIS standards), and is brought into contact with the photosensitive drum A at a contact angle of 25 degrees and a contact pressure of 33 (gf/cm). A plate thickness of the cleaning blade is 2 mm. A metal plate member (having a plate thickness of 1.0 mm) made of SUS is arranged as a backing plate. A free length of the cleaning blade is 8 mm. The cleaning blade is an elastic blade mainly made of urethane. Nylon coating layers in which carbon fluoride with a particle size of 10 $\mu$m or less is dispersed by a dipping method are formed on the portions that are to be contacted at least with the image bearing body on the blade surface, i.e., both surfaces of the blade as shown in FIG. 7 as low frictional coefficient coating layers. The hardness after coating is 85 degrees (Hs). The cleaning blade C provided with the nylon coating layers L is fixed to a blade bonding metal plate M.

The cleaning blade is made of thermoplastic or thermosetting polyurethane and the low frictional coefficient coating layers are formed at the portions that have been brought into contact with at least the image bearing body on the blade surface. However, the coating layer may be provided only at the portion or surface that is brought into contact with the image bearing body of the blade or over the full surface thereof It is preferable that the frictional coefficient of the coating layer of the cleaning blade be in the range of 0.05 to 0.5.

The coating layer may be made of resin or material in which lubricant is dispersed in the resin. In particular, it is preferable to use as the coating layer a nylon layer in which carbon fluoride particles having an average particle size of 10 μm or less are dispersed. It is preferable that the carbon fluoride to be dispersed have a relatively small size that is 10 μm or less whereby it is possible to suppress the unstability of the blade edge when the carbon fluoride is pinched at the cleaning blade nip portion and to prevent the through-pass of the toner.

It is possible to exemplify as a kind of carbon fluoride, for example, CEFBON DM (Trade name, produced by Central Glass Co., Ltd.) of (C2f) n type, CEFBON CMA and CEFBON CMF (Trade names, produced by Central Glass Co., Ltd.) of (CF) n type, carbon fluorides #2065, #1030, #1000 (Trade names, produced by Asahi Glass Co., Ltd.), CF-100 (Trade name, produced by Nippon Carbon Co., Ltd.), also, carbon fluorides #2028, #2010 (Trade names, produced by Asahi Glass Co., Ltd.) of (CF) n type with the fluoride rate changed, and furthermore one obtained by removing fluorine on the surface by processing the above-described carbon fluoride by salt base such as amine.

In particular, nylon is resin that has a suitable hardness. Nevertheless, the material is not limited only to the nylon. It is possible to use for the coating layer acrylic resin, polyester resin, urethane denatured acrylic resin, polyvinyl acetal resin, epoxy resin or the like.

In addition to the above-described carbon fluoride, it is possible to use as the lubricant TOSPEAL (Trade name, silicone particle produced by GE Toshiba Silicone Co., Ltd.).

Figure 8:
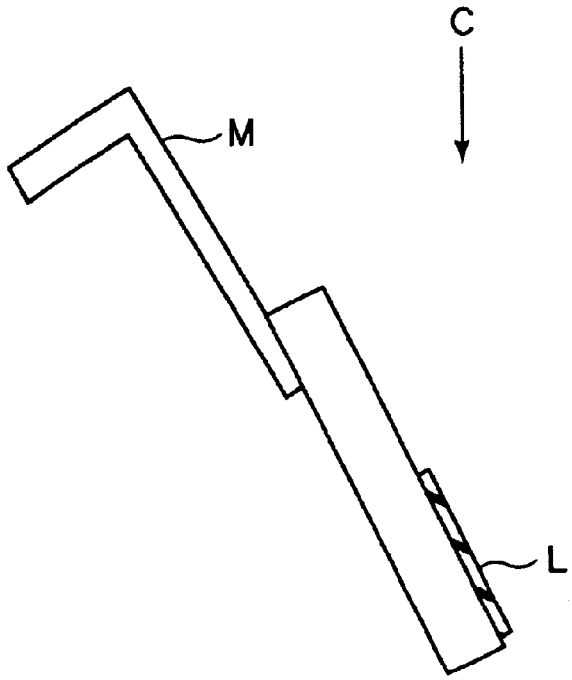
FIG. 8 is a schematic view of a blade in which a nylon layer dispersed with carbon fluoride is formed on one-sided surface of the blade in accordance with a screen printing method.
Figure 9:
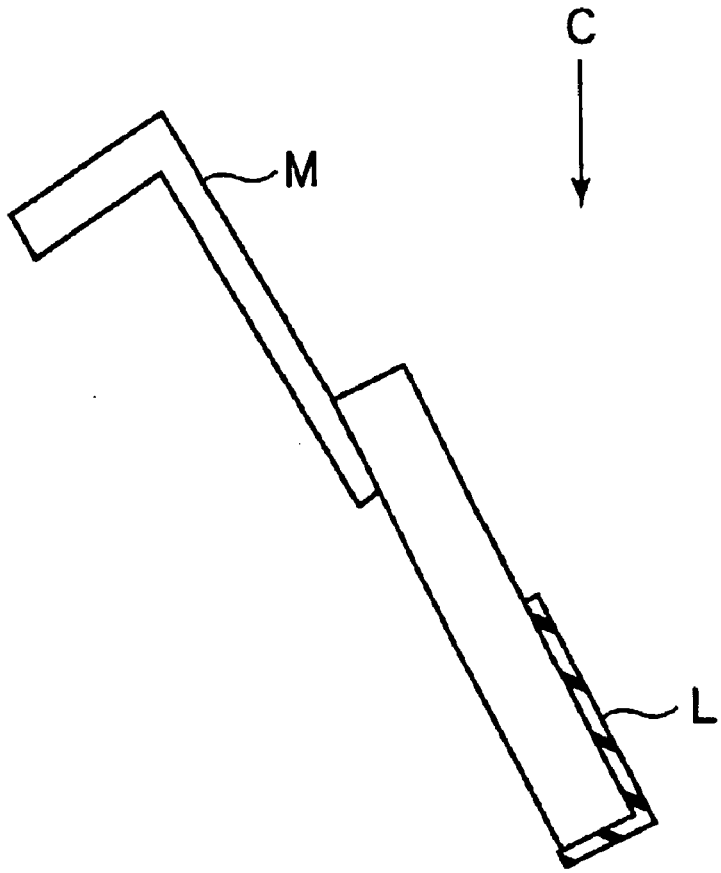
FIG. 9 is a schematic view of a blade in which a nylon layer dispersed with carbon fluoride is formed on one-sided surface of the blade in accordance with a spray coating method.

As an example of the producing method of this blade, first of all, urethane rubber made of the above-described base member was blast processed by means of a polishing machine, and the adhesive layer was formed according to the dipping method. The solution for the adhesive layer formation was obtained by adding diisopropyl ether and N-β-γ-aminopropyl-trimethoxy-silane to solution in which alcohol soluble nylon was dissolved in methanol and agitating the solution for 30 minutes at a room temperature. Subsequently, the solution in which graphitic fluoride (particle size 10 μm or less, produced by Central Glass Co., Ltd.) was added and dispersed to the solution into which nylon was dissolved was again coated on the adhesive layer by the dipping method and was dried for five minutes at 80° C. to thereby form the nylon resin coating layer. The method performed in this example was the coating method according to the dipping method. However, the coating method is not particularly limited but it is possible to use any other suitable method such as a screen printing method, a spray method or a roll coating method. As shown in FIGS. 8 and 9, it is possible to use the blade having the coating layer only on one-sided surface of the blade or only on one surface and a tip end cut section.

It is possible to use as still another coating method coating with inorganic fine particles. For example, fluoride resin particle such as carbon fluoride or silicone resin particles are coated and baked. In this case, the hardness after the coating is in the range of 75 to 90 according to JIS-A.

Also, as a still another coating method, a resin having a high film hardness is impregnated into the blade. For example, acrylic urethane, lactone denatured acrylic urethane, acrylic silicone, phenol resin or the like may be used. In the case where these are used, the hardness after the coating is in the range of 75 to 85 according to JIS-A.

In the apparatus according to the present invention, it is preferable that the toner receiving means be a sheet structure provided at a position where the toner scraped by the blade drops because the structure becomes simple. It is preferable that the sheet structure (hereinafter referred to as a toner receiving sheet) be made of resin because it is light in weight. In particular, it is more preferable that the toner receiving sheet be made of polyurethane or PET. The toner receiving sheet structure is not particularly limited as long as the sheet may receive the dropping toner. It is however preferable to use the toner receiving sheet installed in a direction for contacting in the forward direction of the rotational direction of the drum. The thickness of the toner receiving sheet is not particularly limited. It is sufficient to keep a thickness having such strength that its function may be performed.

A toner breaking member (scraping and dropping member), element B (see FIGS. 2, 4 and 5), is located downstream in the image bearing body moving direction of the above-described toner receiving sheet D but upstream of the cleaning blade C and is used to scrape off the toner accumulated on the toner receiving sheet D, with the toner residing in a position where the toner can not be carried by the waste toner carrying screw E in the vicinity of the contact position between the cleaning blade C and the image bearing body A.

Figure 5:
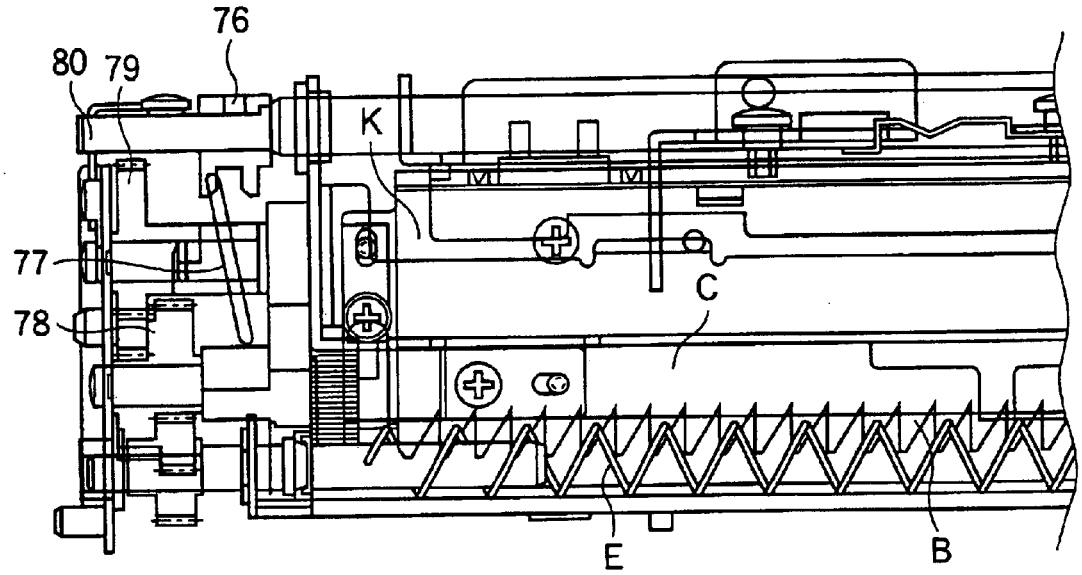
FIG. 5 is a view showing a blade reciprocating mechanism.

In this apparatus, a reciprocating mechanism is provided for reciprocating the cleaning blade C at a predetermined width in the longitudinal direction to the image bearing body A. FIG. 5 shows an example of this reciprocating mechanism.

In FIG. 5, a gear 78 coupled with a drive gear of a developing sleeve rotates in synchronism with the rotation of the developing sleeve. In this case, a gear 79 rotates in synchronism with the gear 78 and a reciprocating cam 77 coupled with the gear 79 rotates. The reciprocating cam 77 has a fan shape having an angle and the fan portion is installed under the condition that it is engaged with a U-shaped member of a cam follower 76. Accordingly, the cam follower 76 and a swing shaft 80 provided with the cam follower 76 swing right and left at a constant cycle in synchronism with the rotation of the reciprocating cam 77. Then, the blade mounting metal plate M mounted on a member fixed to the swing shaft 80 and a mounting metal plate K move together with the swing shaft 80. In accordance with this movement, the cleaning blade C and the toner scraping member B move together.

Figure 4:
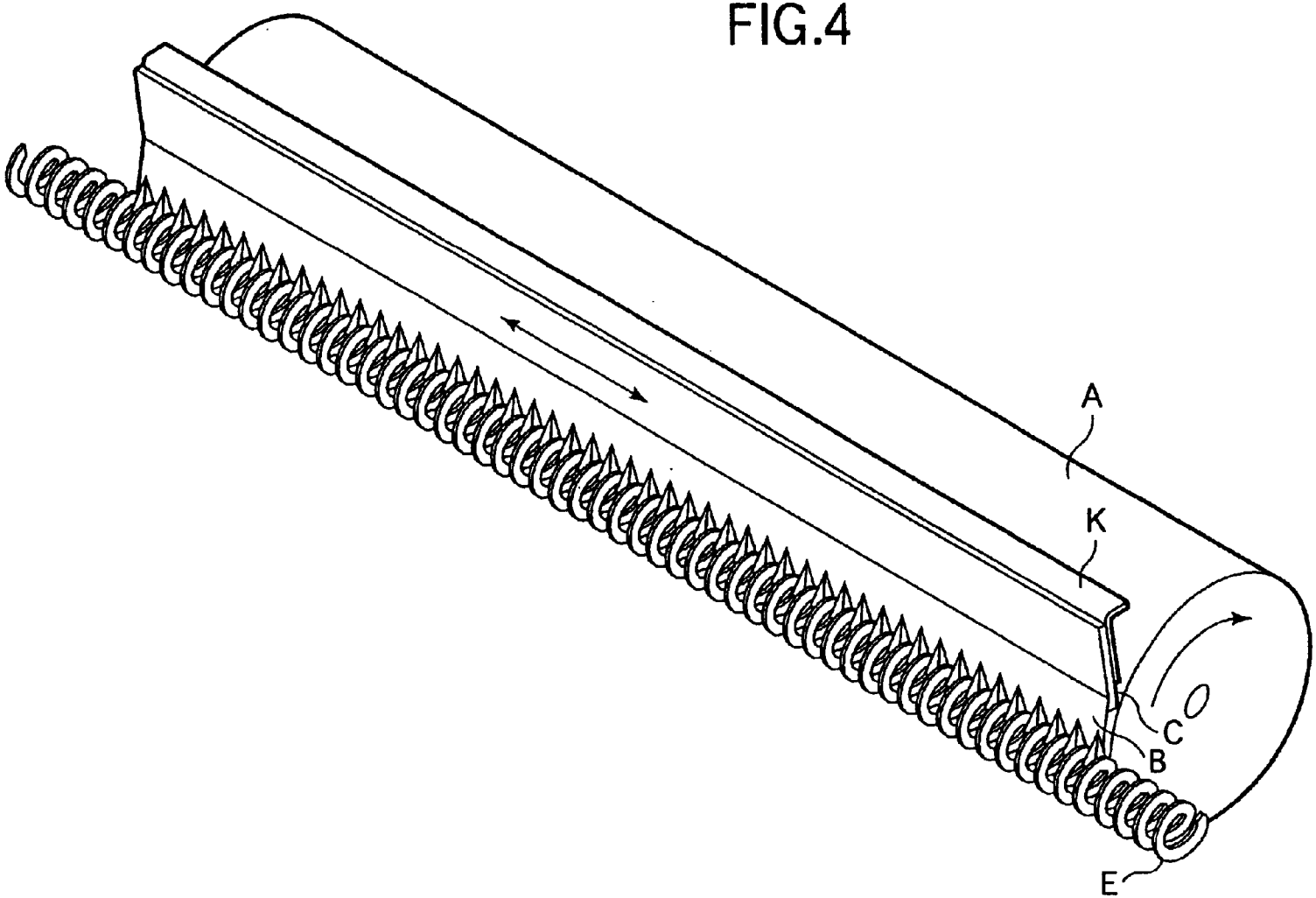
FIG. 4 is a perspective view showing a state of the scraping member and a toner carrying means.

As one form of the scraping member, it is possible to use a member having a structure in which the member reciprocates in synchronism with the reciprocating mechanism and is picked by the interference with the waste toner conveying screw (waste toner carrying screw) during the reciprocating motion. FIG. 4 is a perspective view showing one example of such a structure. It is preferable to use the structure for the above-described member in which the sheet that is cut or folded to a back plate for determining the free length of the cleaning blade so as to interfere with the waste toner carrying screw is bonded.

An example of the scraping member will now be described with reference to FIGS. 2 and 3. This member is a member (hereinafter referred to as a reed screen member) obtained by mounting on the tip end of the metal plate K one obtained by slitting at a plurality of cut positions H in the longitudinal direction a sheet J made of plastics and folding back at the folding-back positions I parts of the sheet portions separated by the slit. Then, the folding-back portion of each reed of the reed screen portion having such a shape is arranged so as to enter the screw pitch of the toner carrying screw E that is the toner conveying member (toner carrying member) and interfere with the latter as shown in FIGS. 2 and 4.

Then, the reciprocating operation is performed whereby the relative position of the screw position and each reed is changed so that the curtain is picked.

Incidentally, this picking operation may be performed in the case where the reciprocating operation is not performed in this structure. Namely, in accordance with the rotational motion of the carrying screw E, the interference point with the moving screw portion is being displaced so that each curtain portion is elastically deformed and separated from the screw portion to take a motion like an elastic spring-back motion when it is deformed at a certain level. In this case, it is possible to scrape off the toner accumulated or residing in the vicinity of the reed screen portion.

In this embodiment, the effective picking operation is performed by the synergy effect of both the reciprocating operation and the screw rotational operation.

There is an additional effect that the toner scraping member B is mounted on the metal plate K to thereby increase the mechanical strength in comparison with these components are made of only plastic sheet. The metal plate may be used as a backing-up member for the cleaning blade. Namely, in FIG. 3, the surface on which the scraping sheet J of the metal plate K is not mounted is brought into contact with the cleaning blade C so that the free length of the blade C is limited as shown in FIG. 2.

Figure 2:
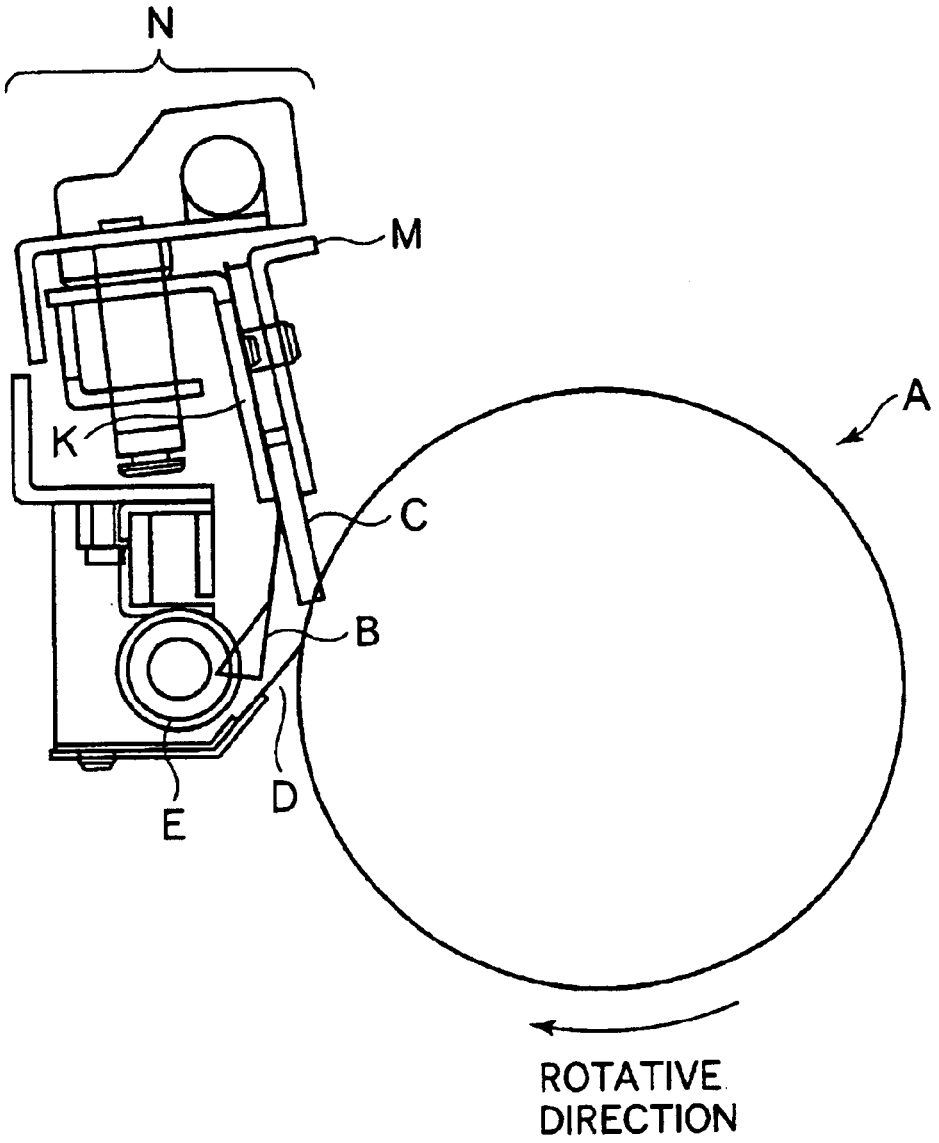
FIG. 2 is a schematic cross-sectional view of the cleaning apparatus according to the present invention.
Figure 3:
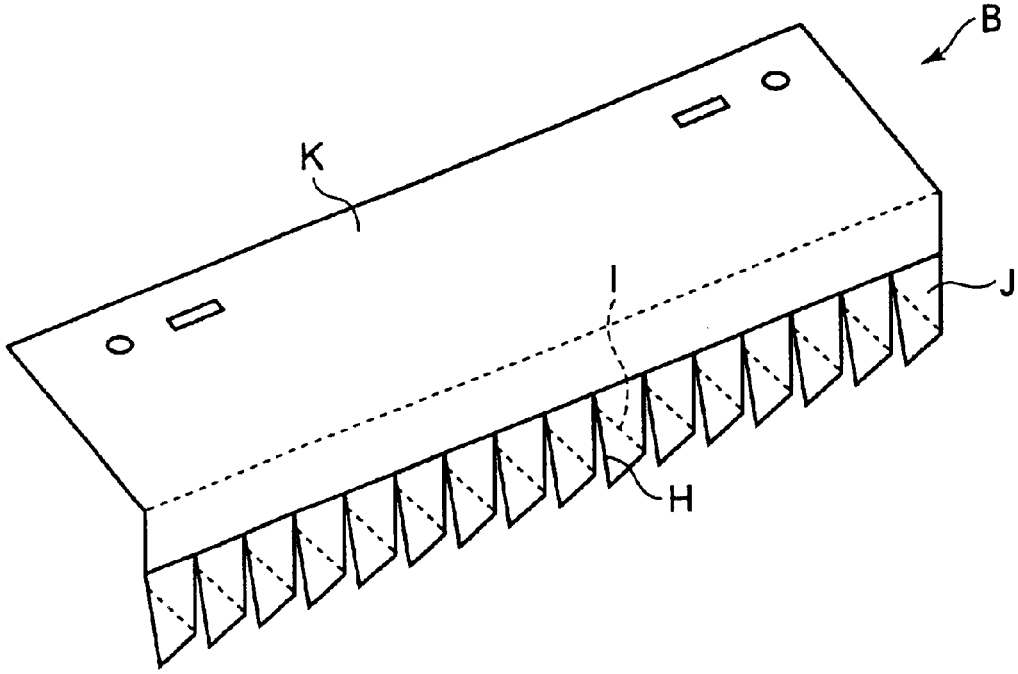
FIG. 3 is a perspective view showing a structure of a toner scraping member.

The reed screen member may be arranged as shown in FIG. 2. In the cleaning apparatus N provided so as to come into contact with the photosensitive drum A that is the image bearing body, the cleaning blade C is kept so as to come into contact with the surface of the photosensitive drum. The toner on the photosensitive drum surface is scraped by means of the cleaning blade, drops on the toner receiving sheet D and is carried in the left direction in the drawing by the waste toner carrying screw E but is also accumulated on the toner receiving sheet D.

On the other hand, if the curtain member B (a.k.a. scraping and dropping member) is arranged so that the folded portion of the curtain interferes with the waste toner carrying screw E and the curtain member is moved in the main scanning direction while following the cleaning blade by the reciprocating mechanism, the curtain member interferes with the screw to be picked. The toner accumulated on the toner receiving sheet D is scraped off by its vibration. Accordingly, the residing of the toner in the cleaning blade nip portion is suppressed, the external additives contained in the toner are hardly resided so that the damage of the image bearing body is decreased.

It is preferable to use mainly hard-flammable resin sheet as the sheet J made of plastics and more preferable to use a hard-flammable PET film. It is also possible to use polyethylene or PI film. Its thickness is not particularly limited. It is sufficient to set a thickness having such a mechanical strength that may perform the function.

A light emitting diode (element GaAlAs) having mainly a peak wavelength of 660 nm is used as a pre-exposure light source 113*a*, 113*b*, 113*c* and 113*d* with a half value width which is ½ of the peak wavelength being at about 25 nm and with the exposure amount of 20 $\mu$J/cm$^2$.

The fixing device 9 is composed of the fixing roller 51, the pressure roller 52, heat-resistant cleaning members 54, 55 for cleaning these rollers, roller heating heaters 56, 57 provided within the rollers 51, 52, a coating roller 50 for coating the fixing roller 51 with mold separating oil such as dimethyl silicone oil, an oil pan 53 therefor, and a thermistor 58 for detecting a temperature of the surface of the pressure roller 52 to thereby control the fixing temperature. In the recording material (recording sheet) P to which the four color toner images have been transferred, the mixture of colors of the toner images and the fixing to the recording material (recording sheet) P are performed by this fixing device 9 to thereby form a full color copy image.

By the way, with respect to the color toner characteristics, first of all, the mixture of the polymerized toner produced by the suspension polymerization and resin magnetic carrier produced by the polymerization method was used as a two-component system developer. A T/D ratio (toner/developer) of the obtained developer was 8%. As the magnetic carrier, one is used in which: the magnetic amount in the magnetic field of one kilo-oersted was 100 emu/cm$^3$; the number average particle size was 40 $\mu$m; and the specific resistance was $10^{13}$ Ωcm. Toner, which was pulverized toner produced by the pulverization method and had a weight average particle size of 8 $\mu$m and average charge amount of 25 $\mu$C/g per unit mass of specific weight of 1.05 g/cm$^3$, was used as non-magnetic polymerized toner.

EMBODIMENT 1

In the above-described image forming apparatus, as shown in FIG. 2, the sheets made of polyurethane were arranged as the toner receiving means for receiving the toner scraped off by the blades on the upstream side in the image bearing body rotational direction of the cleaning blades in the forward direction in the drum rotational direction. By using the cleaning apparatus having the cleaning structure in which the curtain member is attached as the scraping member for scraping the toner stacked on the sheets, an actual copying test of 50,000 of sheets was conducted by copying with an image covered rate of 10% at a room temperature and normal moisture circumstance one by one. The image obtained at 50,000$^{th}$ copy was visually observed and evaluated.

The above-described curtain member had a mechanism in which, as shown in FIGS. 2 and 4, the plastic resin (hard-flammable PET film) sheet was cut like a slit curtain, a part of an end portion of each curtain was folded back (see FIG. 3) and the folded portion was forced to interfere with the waste toner carrying screw. The curtain member was caused to follow the cleaning blade and moved in the main scanning direction by the reciprocating mechanism so that the curtain member interferes with the screw to be picked up. The vibration caused the toner stacked in the vicinity of the curtain member to be scraped.

By using such a cleaning apparatus, the toner residing on the above-described toner receiving sheet was scraped off and caused to jump and fall down to the deep portion of the cleaning apparatus container by the above-described curtain member when the toner stacked to some extent or more (when the toner stacked to interfere with the curtain member). Accordingly, the output 50,000$^{th}$ image was also good without any stack of the toner to the vicinity of the cleaning blade nip and without excessive damage of the image bearing body surface caused by the excessive clamp of the external additives at the nip.

EMBODIMENT 2

Figure 6:
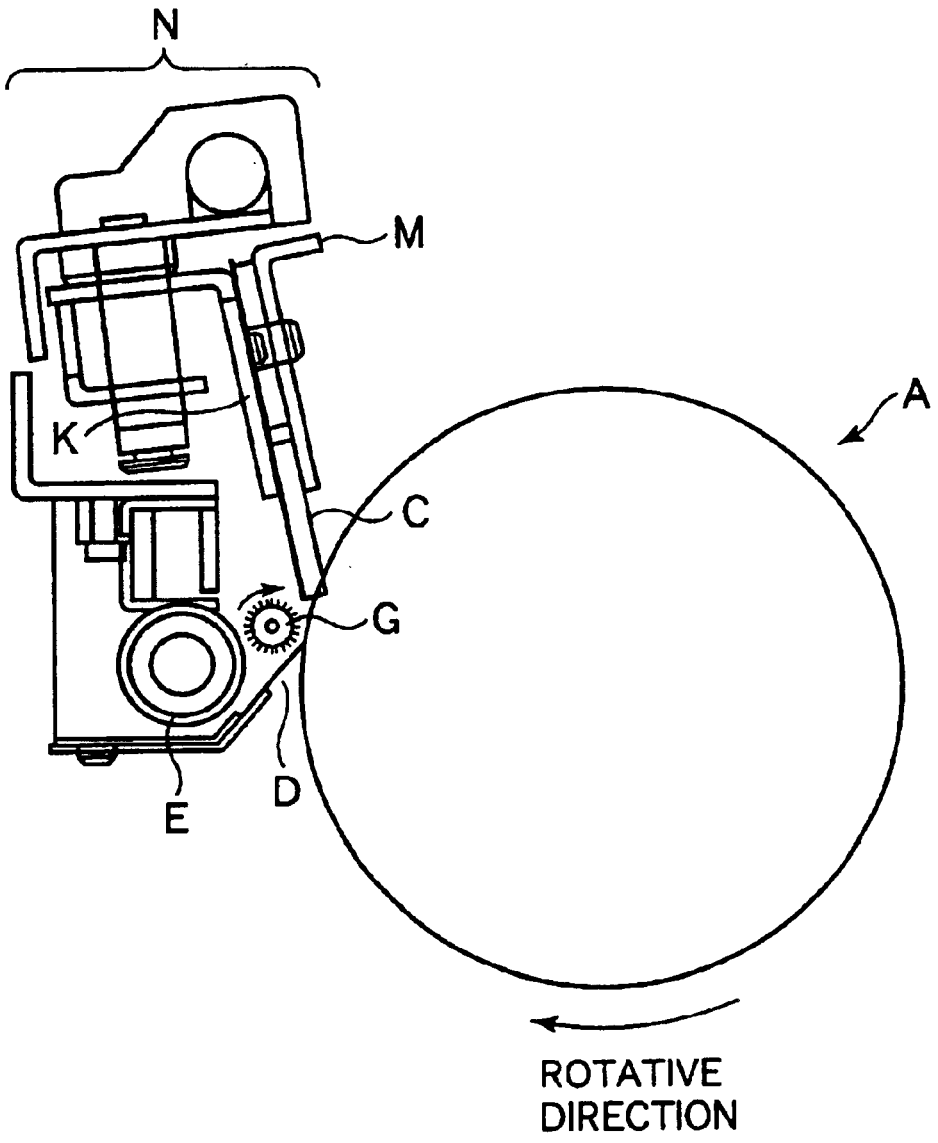
FIG. 6 is a schematic cross-sectional view of a cleaning apparatus in accordance with another embodiment.

Also, it is effective to use a brush-like member as shown in FIG. 6 as another form of the member for scraping the toner stacked on the toner receiving sheet.

In this case, it is preferable to use a synthetic resin having a viscosity or synthetic rubber as a material for the brush G. For example, it is possible to use one or the mixture of plural materials selected from the group consisting of polyvinyl ethyl ether, polyvinyl methyl ether, polyvinyl isobutyl ether, polyisobutylene, butyl rubber, chloroprene rubber, styrene-butadiene rubber (SBR), rubber chloride, cyclization rubber, vinyl chloride-vinyl acetate copolymer, polymethacryl acid, polyacrylic ester, ethylene-vinyl acetate copolymer, and polyvinyl butyral.

It is preferable that the brush G be arranged so as not to interfere with the image bearing body and be rotated so that the moving direction is opposite to the moving direction of the image bearing body in the position facing the image bearing body. With such an arrangement, the effect for preventing the toner scraped by the cleaning blade from stacking on the above-described toner receiving sheet is high.

As shown in FIG. 6, in the above-described image forming apparatus, the sheets made of polyurethane were arranged as the toner receiving means for receiving the toner scraped off by the blades on the upstream side in the image bearing body rotational direction of the cleaning blades in the forward direction in the drum rotational direction. By using the cleaning apparatus having the cleaning structure in which the brush made of polyvinyl ethyl ether is attached as the scraping member for scraping the toner stacked on the toner receiving sheet, an actual copying test of 50,000 sheets was conducted by copying with an image covered rate of 10% at a room temperature and normal moisture circumstance one by one. The image obtained at the $50{,}000^{th}$ copy was visually observed and evaluated. As shown in FIG. 6, the above-described brush was located in a position where the brush never interferes with the image bearing body in the cleaner opening portion and is rotated so as to move in the opposite direction to the moving direction of the image bearing body whereby the toner scraped off by the cleaning blade was prevented from stacking on the above-described toner receiving sheet.

With such a cleaning apparatus, the toner residing on the above-described toner receiving sheet was scraped off and caused to jump and fall down to the deep portion of the cleaning apparatus container when the toner stacked to some extent or more (when the toner stacked to interfere with the brush). Accordingly, the outputted $50{,}000^{th}$ image was also good without any stack of the toner to the vicinity of the cleaning blade nip and without excessive damage of the image bearing body surface caused by the excessive clamp of the external additives at the nip.

COMPARATIVE EXAMPLE 1

As a comparison with Embodiments 1 and 2, in the above-described image forming apparatus, the sheets made of polyurethane were arranged as the toner receiving means for receiving the toner scraped off by the blade on the upstream side in the image bearing body rotational direction of the cleaning blade but the scraping member was not provided in the cleaning apparatus container. Under this condition, an actual copying test of 50,000 sheets was conducted by copying with an image covered rate of 10% at a room temperature and normal moisture circumstance one-by-one. The image obtained was visually observed and evaluated. In this case, the image fault occurred at about the $30{,}000^{th}$ copy. The toner scraped by the cleaning blade was tightly stacked on the toner receiving sheet. The stacked sheet reached the blade edge portions. The external additives having a small particle size excessively resided in the above-described cleaning blade nip. The external additives were pushed against the image bearing body to generate a relatively remarkable flaw in the image bearing body.

EMBODIMENT 3

For example, the above-described toner removing means is preferably a means for rotating in the reverse direction the above-described image bearing body when the image bearing body is rotated in the rearward direction.

The rotation in the rearward direction means a rotation for patch detection usually performed for concentration compensation of the developing device after the completion of the formation of the image on the recording medium. At this time, the image bearing body is rotated in the reverse direction (i.e., the rotation in the opposite direction to the rotational direction upon forming the image), the toner stacked in the vicinity of the cleaning nip upon the formation of the image is scraped off, the toner and the additives contained in the toner are hardly resided in the cleaning blade nip region, and accordingly the damage to the image bearing body may be reduced.

In order to rotate the image bearing body in the reverse direction, it is possible to provide a specialized motor, but it is possible to provide an electric circuit for rotating in the reverse direction a motor for rotating the image bearing body upon the formation of the image. Alternatively, it is possible to cause the motor per se to rotate in the forward direction and to obtain the reverse rotation by gears. Also, it is possible to provide a controlling means for determining the rearward rotation and switching the rotational direction to the reverse direction. The number of reverse rotations is not particularly limited, but it is sufficient to set the number to several times (3 to 4 times).

In the above-described image forming apparatus, the sheets made of polyurethane were arranged as toner receiving means for receiving the toner scraped off by the blade on the upstream side in the image bearing body rotational direction of the cleaning blade. The controlling means 100 is provided as toner removing means for making it possible to rotate the motor for rotating the image bearing body to rotate in the reverse direction which is provided with a sequence for rotating the image bearing body in the reverse direction two to four times upon the rearward rotation of the image bearing body after the formation of the image. Under this condition, an actual copying test of 50,000 sheets was conducted by copying with an image covered rate of 10% at a room temperature and a normal moisture circumstance one by one. The image obtained at the $50{,}000^{th}$ copy was visually observed and evaluated. With such a structure, the toner residing on the toner receiving sheet was popped by force in the gravitational direction given by the reverse rotation performed during the rearward rotation and the minute vibrations generated at that time and then pushed toward the deep portion of the cleaning apparatus container. Accordingly, the toner was no longer stacked in the vicinity of the cleaning blade nip, and the additives were no longer excessively clamped in the nip to cause the excessive damage of the surface of the image bearing body. The $50{,}000^{th}$ outputted image was also good.

EMBODIMENT 4

Also, it is preferable that the above-described toner removing means be a control means for forming the strip-shaped toner image on the image bearing body at a full width of the image region in the main scanning direction upon the rearward rotation of the image bearing body and conducting control such that the toner image reaches the above-described blade.

The length of the strip-shaped image (the direction perpendicular to the main scanning direction) is not particularly limited. If it is about 0.5 g/cm, the image may be striped. The strip-shaped image on the image bearing body reaches the cleaning blade edge upon the rearward rotation so that the toner residing in the vicinity of the nip of the blade upon the formation of the image is broken from the packed condition to pop down. Accordingly, it is hard for the toner and the external additives contained in the toner to reside in the cleaning blade nip region. The damage to the image bearing body may be reduced.

In the above-described image forming apparatus, the sheets made of polyurethane were arranged as the toner receiving means for receiving the toner scraped off by the blade on the upstream side in the image bearing body rotational direction of the cleaning blade. The control means 100 has as a toner removing means such a sequence that the strip-shaped toner image is formed on the image bearing body over the full width of the image region in the main scanning direction about a center of the image bearing body upon the rearward rotation of the image bearing body and such an image is not transferred to reach the cleaning blade. Under this condition, an actual copying test of 50,000 sheets was conducted by copying with an image covered rate of 10% at a room temperature and normal moisture circumstance one by one. The image obtained at the $50{,}000^{th}$ copy was visually observed and evaluated. The strip-shaped image was 290 mm wide (in the longitudinal direction of the image bearing body) and 50 mm long (in the moving direction of the image bearing body). With such an arrangement, the toner residing on the toner receiving sheet and kept under the packed condition in the vicinity of the nip portion is broken and caused to fall by supplying the new toner to the nip portion vicinity at once by the strip-shaped toner image in the full width in the main scanning direction formed upon the above-described rearward rotation. Accordingly, there was no phenomenon that the external additives were clamped in the nip to excessively damage the surface of the image bearing body. The image obtained at the $50{,}000^{th}$ copy was also good.

COMPARATIVE EXAMPLE 2

In comparison with Embodiments 3 and 4, in the above-described image forming apparatus, the toner receiving sheet was not provided, hence under the condition that a gap was present between the bottom surface of the cleaning apparatus container and the image bearing body, an actual test of 50,000 copies was conducted in a circumstance at a room temperature and a normal humidity at an image covering rate of 10%. The obtained image was visually evaluated. The toner removing means was not provided, either. Then, the toner scraped by the cleaning blade was no longer stacked up. Accordingly, the small particle size additives were no longer excessively clamped in the cleaning blade nip. The service life of the image bearing body was prolonged. However, the toner scraped by the cleaning blade was caused to fall down from the cleaning apparatus and dropped onto the transfer belt located below the cleaning apparatus. For this reason, the back stain of the recording material was generated at about 5,000 copies.

As described above, according to the present invention, the toner residing in the vicinity of the blade nip portion is effectively removed so that the generation of the abraded damage of the image bearing body surface may be suppressed.

Also, as a result, it is possible to remarkably enhance the reliability of the electrophotographic apparatus.

Incidentally, the present invention is not limited to the structure described in this specification and may be applied to any structure to which the technical concept of the present invention is applied.

What is claimed is:

1. A cleaning apparatus comprising:

a cleaning member for collecting toner by contacting a surface of an image bearing body, which bears a toner image;

toner conveying means for conveying the collected toner; and a toner breaking member disposed in the vicinity of a contact portion between the image bearing body and said cleaning member for breaking the collected toner in the vicinity of the contact portion, wherein said toner breaking member moves in association with a toner conveying operation of said toner conveying means, and wherein said cleaning member includes a layer and a base member, wherein said layer has a hardness, which is higher than a hardness of said base member at least at the contact portion.

2. A cleaning apparatus according to claim 1, wherein said layer is a coating layer.

3. A cleaning apparatus according to claim 1, wherein said layer is formed of a material including nylon in which carbon fluoride is dispersed.

4. A cleaning apparatus according to claim 1, wherein said base member is made of polyurethane.

5. A cleaning apparatus comprising:

a cleaning member for collecting toner by contacting a surface of an image bearing body, which bears a toner image;

cleaning member moving means for reciprocally moving said cleaning member in a longitudinal direction of the image bearing body;

a toner breaking member, which moves in association with a moving operation of said cleaning member, and is disposed in a vicinity of a contact portion between the image bearing body and said cleaning member for breaking the collected toner in the vicinity of the contact portion; and toner conveying means for conveying the collected toner, wherein at least a part of said toner breaking member is disposed at a position where said part interferes with said toner conveying means.

6. A cleaning apparatus according to claim 5, wherein said toner conveying means includes a conveying screw, and wherein said toner breaking member is disposed so as to interfere with a rotational region of said conveying screw.

7. A cleaning apparatus according to claim 6, wherein said toner breaking member includes a plurality of free end portions, wherein said plurality of free end portions interfere with the rotational region of said conveying screw.

8. A cleaning apparatus according to claim 5, wherein said cleaning member includes a layer and a base member, wherein said layer has a hardness, which is higher than a hardness of said base member at least at the contact portion.

9. A cleaning apparatus according to claim 8, wherein said layer is formed of a material including nylon in which carbon fluoride is dispersed.

10. A cleaning apparatus according to claim 8, wherein said base member is made of polyurethane.

11. A cleaning apparatus according to claim 5, further comprising toner receiving means disposed at an upstream side in an image bearing body moving direction of the contact portion between the image bearing body and said cleaning member for receiving the collected toner by said cleaning member.

12. An image forming apparatus comprising:

image forming means for forming a toner image on a surface of an image bearing body;

transfer means for transferring the toner image on the image bearing body to a recording material;

a cleaning member contacting a surface of the image bearing body for collecting toner;

toner conveying means for conveying the collected toner; and a toner breaking member disposed in a vicinity of a contact portion between the image bearing body and said cleaning member for breaking the collected toner in a vicinity of the contact portion, wherein said toner breaking member moves in association with a toner conveying operation of said toner conveying means, and wherein said cleaning member includes a layer and a base member, wherein said layer has a hardness, which is higher than a hardness of said base member at least at the contact portion.

13. An image forming apparatus according to claim 12, wherein said layer is a coating layer.

14. An image forming apparatus according to claim 13, wherein said coating layer is formed of a material including nylon in which carbon fluoride is dispersed.

15. An image forming apparatus according to claim 12, wherein said base member is made of polyurethane.

16. An image forming apparatus comprising:

image forming means for forming a toner image on a surface of an image bearing body;

transfer means for transferring the toner image on the image bearing body to a recording material;

a cleaning member contacting a surface of the image bearing body for collecting toner;

cleaning member moving means for reciprocally moving said cleaning member in a longitudinal direction of the image bearing body;

a toner breaking member, which moves in association with a moving operation of said cleaning member and is disposed in a vicinity of a contact portion between the image bearing body and said cleaning member for breaking the collected toner in the vicinity of the contact portion; and toner conveying means for conveying the collected toner, wherein at least a part of said toner breaking member is located at a position where said part interferes with said toner conveying means.

17. An image forming apparatus according to claim 16, wherein said toner conveying means includes a conveying screw, and wherein said toner breaking member is disposed so as to interfere with a rotational region of said conveying screw.

18. An image forming apparatus according to claim 17, wherein said toner breaking member includes a plurality of free end portions, wherein said plurality of free end portions interfere with the rotational region of said conveying screw.

19. An image forming apparatus according to claim 16, wherein said cleaning member includes a coating layer formed of a material with a higher hardness than that of a base member forming said cleaning member at least at the contact portion.

20. An image forming apparatus according to claim 19, wherein said layer is formed of a material including nylon in which carbon fluoride is dispersed.

21. An image forming apparatus according to claim 19, wherein said base member is made of polyurethane.

22. An image forming apparatus according to claim 16, further comprising toner receiving means disposed at an upstream side in an image bearing body moving direction of the contact portion between the image bearing body and said cleaning member for receiving the collected toner collected by said cleaning member.

23. A cleaning apparatus comprising:

a cleaning member for collecting toner by abutting a surface of an image bearing member, which bears a toner image;

toner conveying means for conveying the collected toner;

a toner breaking member disposed in a vicinity of a contact portion between the image bearing member and said cleaning member for breaking the collected toner in a vicinity of the contact portion; and a supporting member for supporting said toner breaking member, wherein said supporting member inhibits a transformation of said cleaning member, and wherein said toner breaking member moves in association with a toner conveying operation of said toner conveying means.

24. A cleaning apparatus comprising:

a cleaning member for collecting toner by abutting a surface of an image bearing member for bearing a toner image;

toner conveying means for conveying the collected toner; and a toner breaking member disposed in a vicinity of a contact portion between the image bearing member and said cleaning member for breaking the collected toner in a vicinity of the contact portion, wherein said toner breaking member includes a folded portion to interfere with said toner conveying means and moves in association with a toner conveying operation of said toner conveying means, and wherein said folded portion is formed by being folded in a condition that a longitudinal direction of said toner conveying means is angled with respect to a surface of said folded portion.

25. An image forming apparatus comprising:

image forming means for forming a toner image on an image bearing member;

a transferring means for transferring the toner image on the image bearing member onto a recording material;

a cleaning member for collecting toner by abutting a surface of the image bearing member;

toner conveying means for conveying the collected toner;

a toner breaking member disposed in a vicinity of a contact portion between the image bearing member and said cleaning member for breaking the collected toner in a vicinity of the contact portion; and a supporting member for supporting said toner breaking member, wherein said supporting member inhibits a transformation of said cleaning member, and wherein said toner breaking member moves in association with a toner conveying operation of said toner conveying means.

26. An image forming apparatus comprising:

image forming means for forming a toner image on an image bearing member;

transferring means for transferring the toner image on the image bearing member onto a recording material;

a cleaning member for collecting toner by abutting a surface of the image bearing member;

toner conveying means for conveying the collected toner; and a toner breaking member disposed in a vicinity of a contact portion between the image bearing member and said cleaning member for breaking the collected toner in a vicinity of the contact portion, wherein said toner breaking member includes a folded portion to interfere with said toner conveying means and moves in association with a toner conveying operation of said toner conveying means, and wherein said folded portion is formed by being folded in a condition that a longitudinal direction of said toner conveying means is angled with respect to a surface of said folded portion.

* * * * *

UNITED STATES PATENT AND TRADEMARK OFFICE

CERTIFICATE OF CORRECTION

PATENT NO. : 6,832,067 B2
DATED : December 14, 2004
INVENTOR(S) : Norihiko Kubo

It is certified that error appears in the above-identified patent and that said Letters Patent is hereby corrected as shown below:

Column 1,
Line 32, "Thus, it also becomes an important task to" should be deleted;
Lines 33 and 34, should be deleted;
Line 41, "and of the" should read -- and the --; and
Line 65, "rubber is" should read -- rubber, which is --.

Column 6,
Line 1, "l*a*to" should read -- l*a* to --.

Column 8,
Line 26, "can not" should read -- cannot --.

Column 9,
Line 37, "of" should be deleted.

Column 10,
Line 39, "at" should read -- at the --.

Signed and Sealed this

Twenty-fourth Day of May, 2005

JON W. DUDAS
*Director of the United States Patent and Trademark Office*